US006131890A

United States Patent [19]

Fischer et al.

[11] Patent Number: 6,131,890

[45] Date of Patent: Oct. 17, 2000

[54] DIAPHRAGM CARBURETOR SYSTEM

[75] Inventors: Martin Fischer, Baiersdorf; Manfred Heybeck, Eckental, both of Germany

[73] Assignee: Fritz Hintermayr GmbH Bing-Vergaser-Fabrik, Nuremberg, Germany

[21] Appl. No.: 09/023,957

[22] Filed: Feb. 17, 1998

[30] Foreign Application Priority Data

Feb. 14, 1997 [DE] Germany ..... 197 05 639
Nov. 19, 1997 [EP] European Pat. Off. ..... 97120260

[51] Int. Cl.[7] ..... F02M 17/04

[52] U.S. Cl. ..... 261/35; 261/69.1; 261/DIG. 68

[58] Field of Search ..... 261/35, 69.1, 69.2, 261/DIG. 68

[56] References Cited

U.S. PATENT DOCUMENTS

| | | | |
|---|---|---|---|
| 3,167,599 | 1/1965 | Brown et al. | 261/69.2 X |
| 3,169,154 | 2/1965 | Martin et al. | 261/69.2 X |
| 3,174,730 | 3/1965 | Barr | 261/DIG. 68 |
| 3,738,622 | 6/1973 | Tuckey | 261/35 |
| 4,508,068 | 4/1985 | Tuggle et al. | 261/DIG. 68 |
| 4,563,311 | 1/1986 | Agnew | 261/35 |
| 5,676,887 | 10/1997 | Soeda et al. | 261/35 |
| 5,794,593 | 8/1998 | Sugii | 261/35 X |

FOREIGN PATENT DOCUMENTS

| | | |
|---|---|---|
| 44 09 887 A1 | 9/1995 | Germany . |
| 196 04 553 A1 | 8/1996 | Germany . |

*Primary Examiner*—Richard L. Chiesa
*Attorney, Agent, or Firm*—Herbert L. Lerner; Laurence A. Greenberg; Werner H. Stemer

[57] ABSTRACT

A diaphragm carburetor system includes a diaphragm-controlled closed-loop control chamber for fuel communicating through a number of fuel conduits with an aspiration conduit for air. All of the fuel conduits extend separately from one another over their entire length in order to attain the least possible acceleration delay with simultaneously high efficiency. As a result, both a main channel and an idling conduit and each partial load conduit are supplied with fuel from the control chamber. Since an entry of air is prevented both into the partial load conduit or conduits and into the idling conduit, each conduit remains completely filled with fuel during the entire period of operation, so that upon sudden acceleration events, the fuel can emerge into the aspiration conduit of the diaphragm carburetor without delay.

13 Claims, 3 Drawing Sheets

DIAPHRAGM CARBURETOR SYSTEM

BACKGROUND OF THE INVENTION

Field of the Invention

The invention relates to a diaphragm carburetor, in particular for use in a two-stroke engine, including a diaphragm-controlled closed-loop control chamber for fuel that communicates through a number of fuel conduits with an aspiration conduit for air.

A diaphragm carburetor is used to adjust the combustion mixture of air as well as fuel finely dispersed in the air, which is required in the applicable operating state of an internal combustion engine, especially in the idling, partial-load and full-load operating modes, in a mixture ratio that is optimized for combustion. Typically, diaphragm carburetors are used on one hand in small tools, such as a power chainsaw. On the other hand, diaphragm carburetors constructed for comparatively large motors, such as motors with a displacement of more than 300 $cm^3$, are often used in motor boats and especially in so-called jet skis.

In a diaphragm carburetor known from German Published, Non-Prosecuted Patent Application DE 44 09 887 A1, a further conduit system is present in addition to a main channel for the outlet of fuel into an aspiration conduit. That conduit system includes an emulsion chamber, which communicates with a closed-loop control chamber for fuel delivery and from which a bypass conduit and an idling conduit branch off. The idling conduit discharges through its outlet opening into a partial chamber of the aspiration conduit oriented toward the motor, while the bypass conduit discharges into a partial chamber remote from the motor. The two partial chambers are separated in the idling mode by a rotary throttle valve disposed in the aspiration conduit, which nearly closes the aspiration conduit in the idling mode. When the motor is running, a negative pressure develops in the partial chamber toward the motor, while atmospheric pressure prevails in the partial chamber remote from the motor. As a consequence of that pressure difference between the two partial chambers, air is aspirated through the bypass conduit and mixes with fuel in the emulsion chamber. The fuel-air mixture is aspirated through the idling conduit and delivered to the motor.

Upon acceleration with the attendant tilting of the throttle valve, the outlet openings of the bypass conduit enter the negative pressure range. That causes a reversal of the flow direction in the bypass conduit and the emergence of fuel through the bypass openings into the aspiration conduit. Therefore, in partial-load operation, the bypass conduit serves to deliver fuel and thus performs the function of a partial load conduit. However, until pure fuel, that is fuel unmixed with air, can be dispensed into the aspiration conduit, the air located in the emulsion chamber and in the bypass conduit must first be positively displaced. Upon an abrupt opening of the throttle valve, that leads to delayed acceleration of the motor. In tools, such as a power chainsaw, that effect is of only slight significance. In motor boats and especially jet skis, poor motor pickup is extremely undesirable.

In the prior art which is disclosed, for instance, in German Published, Non-Prosecuted Patent Application DE 196 04 553 A1, an acceleration pump in the form of an additional diaphragm pump which is actuated through a cam coupled to the pivot axis of the throttle valve, is used to overcome that problem. The acceleration pump sends a fuel surge into the carburetor upon a complete, sudden opening of the throttle valve. The fuel surge suffices to compensate for the aforementioned delays in acceleration. Fuel supply subsequently takes place essentially through the main channel. However, the acceleration pump causes a great deviation in the fuel-air mixture ratio from the optimal range for combustion, because of the sudden fuel surge during the acceleration event. That deviation is expressed in a worsening of motor efficiency. On one hand, it makes for high fuel consumption and on the other hand high pollutant emissions. Integrating an additional acceleration pump into the carburetor system also requires complicated, cost-intensive planning of the construction.

A further problem arises when an acceleration pump is used, particularly in a jet ski. In harbor areas, jet skis must run at idling rpm and thus at a walking pace. Trips of that kind can last up to 15 minutes. During that period, the combustion mixture collects in the crankcase. Upon a sudden increase in motor rpm, the mixture is activated and is aspirated into the combustion chamber along with the fuel injected by the acceleration pump. The result can be unstable operation and in an extreme case even failure of the motor.

SUMMARY OF THE INVENTION

It is accordingly an object of the invention to provide a diaphragm carburetor system, which overcomes the hereinafore-mentioned disadvantages of the heretofore-known devices of this general type, which has a simple mechanical structure and which assures good acceleration performance and at the same time low pollutant emissions and low fuel consumption.

With the foregoing and other objects in view there is provided, in accordance with the invention, a diaphragm carburetor, comprising an aspiration conduit for air; a diaphragm-controlled closed-loop control chamber for fuel; and a number of fuel conduits communicating between the control chamber and the aspiration conduit, the fuel conduits including at least one partial load conduit with a given length and one idling conduit, the partial load conduit or conduits extend separately over all of the given length from the idling conduit, dispensing with an emulsion chamber.

The invention proceeds from the concept that an acceleration pump can be omitted if the acceleration delay that occurs in a diaphragm carburetor without an acceleration pump can be overcome in an alternative way. Since it is known that the entry of air into a partial load conduit blocks that conduit for spontaneous reaction to sudden pressure changes, and moreover the failure of delivery of the partial-load fuel is the cause of the delay in acceleration, the goal is to assure that regardless of the operating state, all of the fuel conduits are always fully filled with fuel. This can be attained if a direct communication between a bypass or partial load conduit and the idling conduit, especially through an emulsion chamber, is avoided.

In accordance with another feature of the invention, all of the fuel conduits are blocked for air ducting. Since moreover the fuel conduits communicate directly with the fuel-filled closed-loop control chamber of the diaphragm carburetor through their outlet openings in the wall of the aspiration conduit, communication between the idling conduit and each of the partial load conduits is prevented.

In accordance with a further feature of the invention, depending on the function of the motor, at least one further partial load conduit (or transition conduit) may be selectively provided in addition to a single partial load conduit. Then each partial load conduit extends separately both from every other partial load conduit and from the idling conduit over its entire length.

In accordance with an added feature of the invention, an entry of air from the aspiration conduit into one of the partial load conduits during idling can be prevented through the use of at least one check valve disposed in the partial load conduit.

In accordance with again another feature of the invention, there is provided a throttle valve disposed in the aspiration conduit.

In accordance with an additional feature of the invention, each partial load conduit communicates with the aspiration conduit through at least one outlet opening. Preferably, however, two outlet openings each are provided, and the outlet openings of each partial load conduit are disposed in succession in the flow direction of the aspirated air. These outlet openings can be activated in succession to allow fuel through them, depending on the position of the throttle valve. As a result, the fuel surge can be adapted especially exactly to the current load state, particularly in partial-load operation.

In accordance with yet another feature of the invention, the fuel flow is throttled separately in each conduit through the use of intervening nozzles. As a result, the fuel quantity required for each of the operating states of the diaphragm carburetor can be adjusted independently.

In accordance with yet a further feature of the invention, the nozzle element disposed in the idling conduit is constructed as an adjustable needle valve. In this embodiment it is possible to regulate the idling fuel surge and thus the idling rpm of the motor, even after the carburetor has been manufactured.

In accordance with yet an added feature of the invention, instead of the regulatable needle valve, a rigid idling nozzle (fixed throttle) is used as the nozzle element in the idling conduit. This fixes the idling rpm at the factory and the idling rpm is then invariable once the diaphragm carburetor has been finished. This prevents improper adjustment of the carburetor.

In accordance with yet an additional feature of the invention, the aspiration conduit has a region shaped as a Venturi portion, and the main channel has an outlet opening discharging into the Venturi portion.

In accordance with again a further feature of the invention, there is provided a preatomizer disposed in the Venturi portion, the main channel discharging into the preatomizer.

In accordance with a concomitant feature of the invention, the partial load conduit or conduits have at least one outlet opening, and the outlet openings of the at least one partial load conduit and the main channel are activatable in succession by positioning the throttle valve for discharging fuel unmixed with air through the outlet openings into the aspiration conduit.

The advantages attained with the invention are in particular that by separating each partial load conduit from the idling conduit, all of the fuel delivery conduits, but in particular each partial load conduit, are completely filled with fuel during the entire period of operation. Upon a sudden opening of the throttle valve, fuel can therefore emerge through it as soon as the corresponding outlet opening reaches the negative pressure range.

In this regard, experiments have shown that the acceleration pump can be omitted because of the direct availability of the partial-load fuel and the pure fuel in the idling conduit, which permits economical manufacture of the diaphragm carburetor. The fuel quantity, together with the fuel quantity already collected in the crank case of the two-stroke motor, suffices to compensate for the acceleration hole that occurred in the old system. Since the fuel quantity collected in the pump is not additionally introduced into the motor, low fuel combustion and low pollutant emissions are achieved. Moreover, uneven motor operation from overenrichment of the combustion mixture upon sudden acceleration is averted. The diaphragm carburetor is moreover assured against improper adjustment by using a fixed throttle to adjust the idling rpm of the motor.

Other features which are considered as characteristic for the invention are set forth in the appended claims.

Although the invention is illustrated and described herein as embodied in a diaphragm carburetor system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
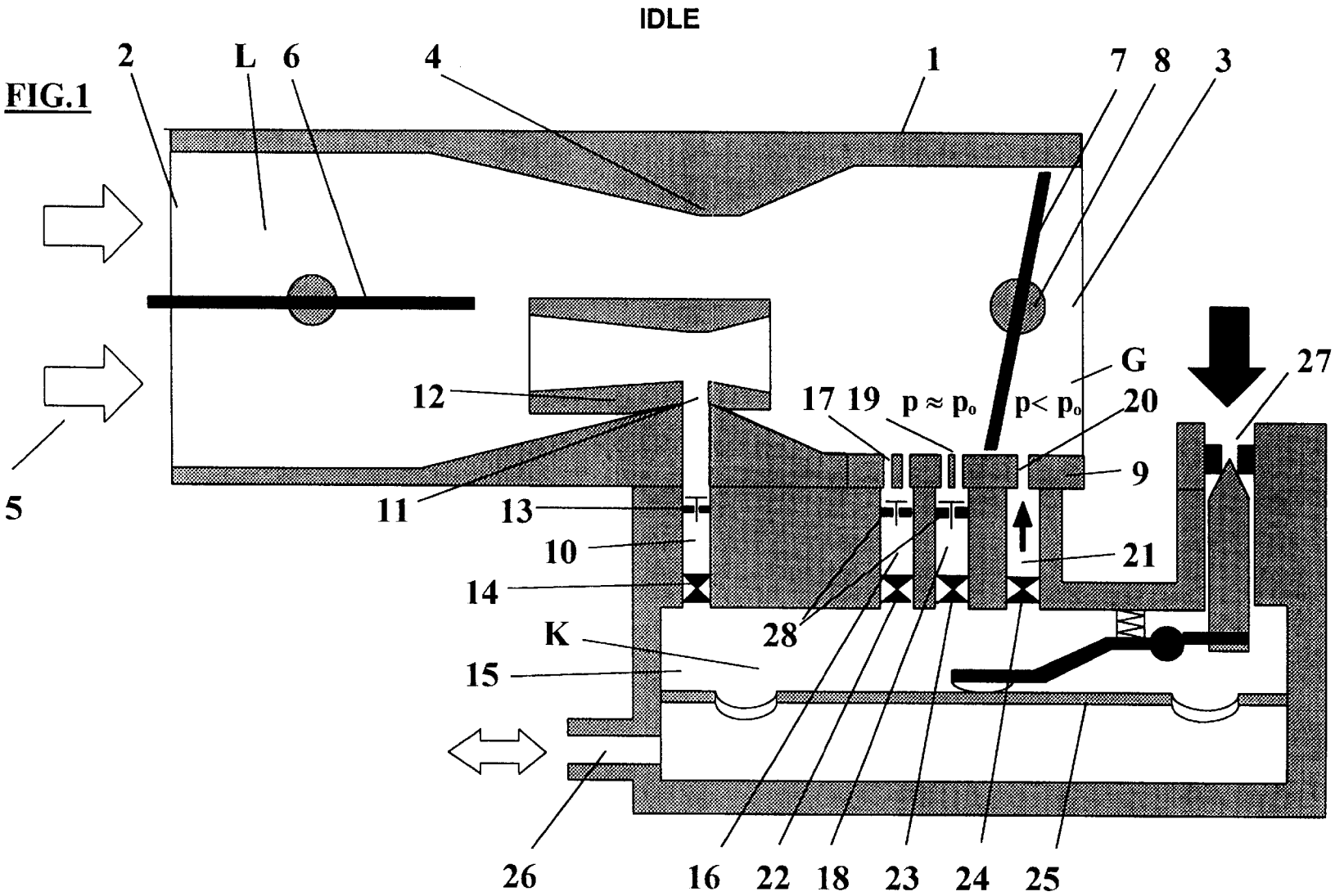
FIG. 1 is a diagrammatic, vertical-sectional view of a diaphragm carburetor with fuel conduits separated from one another in an idling mode.

Referring now to the figures of the drawings in detail and first, particularly, to FIG. 1 thereof, there is seen a diaphragm carburetor which has an aspiration conduit 1 that extends through an entire length of a non-illustrated carburetor housing. The aspiration conduit 1 has an annular constriction for forming a Venturi portion 4, in an inner region between an inlet-side opening 2 and an outlet-side or motor-side opening 3. Air L is aspirated through the inlet-side opening 2 during operation of the diaphragm carburetor. This air is mixed in the interior of the aspiration conduit 1 with finely dispersed fuel K and is delivered to the non-illustrated motor as a combustion mixture G through the opening 3 facing toward the motor. The direction of the air flow is indicated in the drawings by arrows 5.

A choke 6 which is movably supported in the region of the inlet-side opening 2 is needed only for starting. During operation of the diaphragm carburetor, the choke is in the fully open position shown. The flow rate of the emulsion, that is, the mixture G of air L and finely dispersed fuel K, which determines the instantaneous power of the motor, is regulated by a throttle valve 7, which is angularly adjustably supported about a center shaft 8 in the aspiration conduit 1 near the opening 3 facing toward the motor.

In order to deliver fuel to the aspiration conduit, a number of fuel conduits are provided which have outlet openings located one behind the other, in the flow direction of the aspirated air L, in a wall 9 of the aspiration conduit 1. To that end, the diaphragm carburetor includes a main channel 10, having an outlet opening 11 that discharges into a preatomizer or pre-Venturi 12 positioned in the Venturi portion 4. This preatomizer 12 may also be omitted. In that case, the main channel 10 discharges through its outlet opening 11 directly into the aspiration conduit 1. The outlet opening 11 is connected through the main channel 10 to a closed-loop control chamber 15 filled with fuel K. The main channel 10 has a check valve 13 and a main nozzle 14 preceding it on the fuel side.

Two outlet openings 17 of a first conduit 16 are located downstream of the outlet opening 11. The first conduit is referred to below as an upper partial load conduit or transition conduit 16. This upper partial load conduit 16 can be provided or be omitted, depending on the motor function. Two outlet openings 19 of a second partial load conduit 18 are in turn located downstream second outlet openings 17. The second partial load conduit 18 is referred to below as a lower partial load conduit 18. An outlet opening 20 of an idling conduit 21 is positioned downstream of these outlet openings 19. The upper partial load conduit 16 and the lower partial load conduit 18 extend separately from one another and separately from the idling conduit 21 over their entire length. Each of the conduits 16, 18 and 21 thus communicates separately with the control chamber 15, from which they are supplied with fuel K. The number of outlet openings 17, 19 depends essentially on the adaptation to the particular motor, so that it is also possible for only a single outlet opening 17, 19 per partial load conduit 16 or 18 to be provided.

The fuel flow through the upper partial load conduit 16 is adjusted through the use of a nozzle element 22 and the fuel flow through the lower partial load conduit 18 is likewise adjusted through the use of a nozzle element 23. The fuel flow through the idling conduit 21 is regulated through the use of a separate nozzle element 24 independently thereof. The pressure in the control chamber 15 is adjusted through a diaphragm 25, which is acted upon through an opening 26 with a reference pressure, such as atmospheric pressure $p_0$. If the pressure in the control chamber 15 drops below a predetermined value, then the diaphragm 25 opens a needle valve 27 connected thereto, so that fuel K can flow into the control chamber 15 to replenish it.

Figure 2:
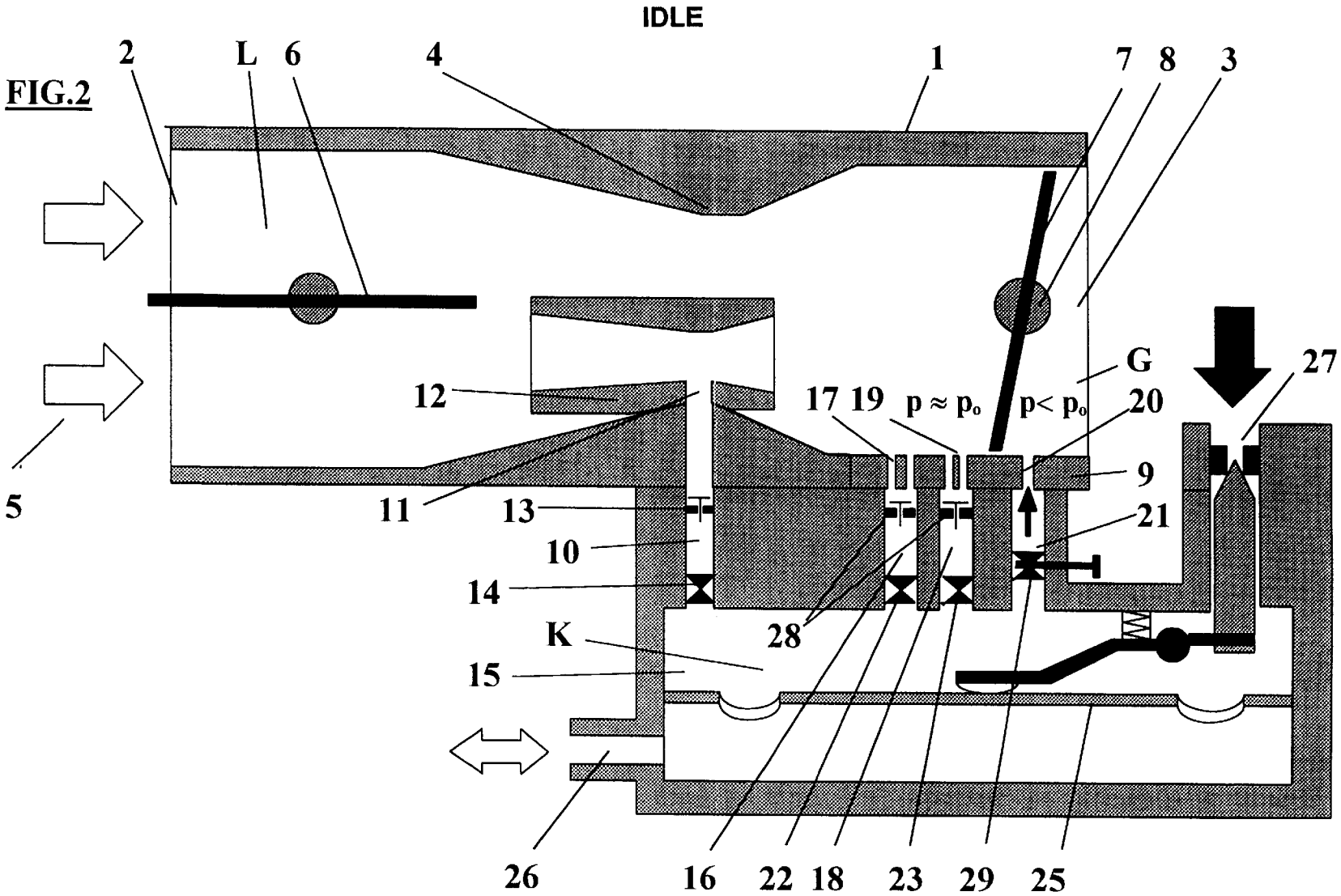
FIG. 2 is a vertical-sectional view of the diaphragm carburetor of FIG. 1 with an adjustable needle valve in an idling conduit.

FIGS. 1 and 2 show the diaphragm carburetor in an idling mode. The throttle valve 7 is adjusted in such a way that it covers a maximum cross-sectional area of the aspiration conduit 1. As a result, the interior of the aspiration conduit 1 is subdivided into a negative pressure region ($p<p_0$) toward the motor and a normal pressure region ($p\approx p_0$) toward the inlet-side opening 2. With the throttle valve 7 in the idling position, the outlet opening 20 of the idling conduit 21 is in the negative pressure range, or in other words is downstream of the throttle valve 7 in terms of the air flow direction 5. As a consequence of the negative pressure generated by the motor, fuel K is aspirated out of the idling conduit 21 into the aspiration conduit 1 and delivered to the motor. In order to set a desired idling rpm, the flow rate in the idling conduit 21 is preferably set at the factory through the use of a rigid nozzle element 24 (fixed throttle). The outlet openings 17 and 19 of both respective partial load conduits 16 and 18 as well as the outlet opening 11 of the main channel 10 are located in the normal pressure range. Therefore, no escape of fuel K through these outlet openings 11, 17 and 19 takes place. The check valve 13 serves to prevent the entry of air L into the main channel 10. Analogously, check valves 28 each prevent the entry of air L into an arbitrary one of the respective partial load conduits 16 or 18.

In the exemplary embodiment of the diaphragm carburetor shown in FIG. 2, the flow rate of the idling fuel is regulated not by a fixed throttle but through the use of an adjustable needle valve 29. In this version, it is possible to set the idling rpm even after the diaphragm carburetor has been manufactured.

Figure 3:
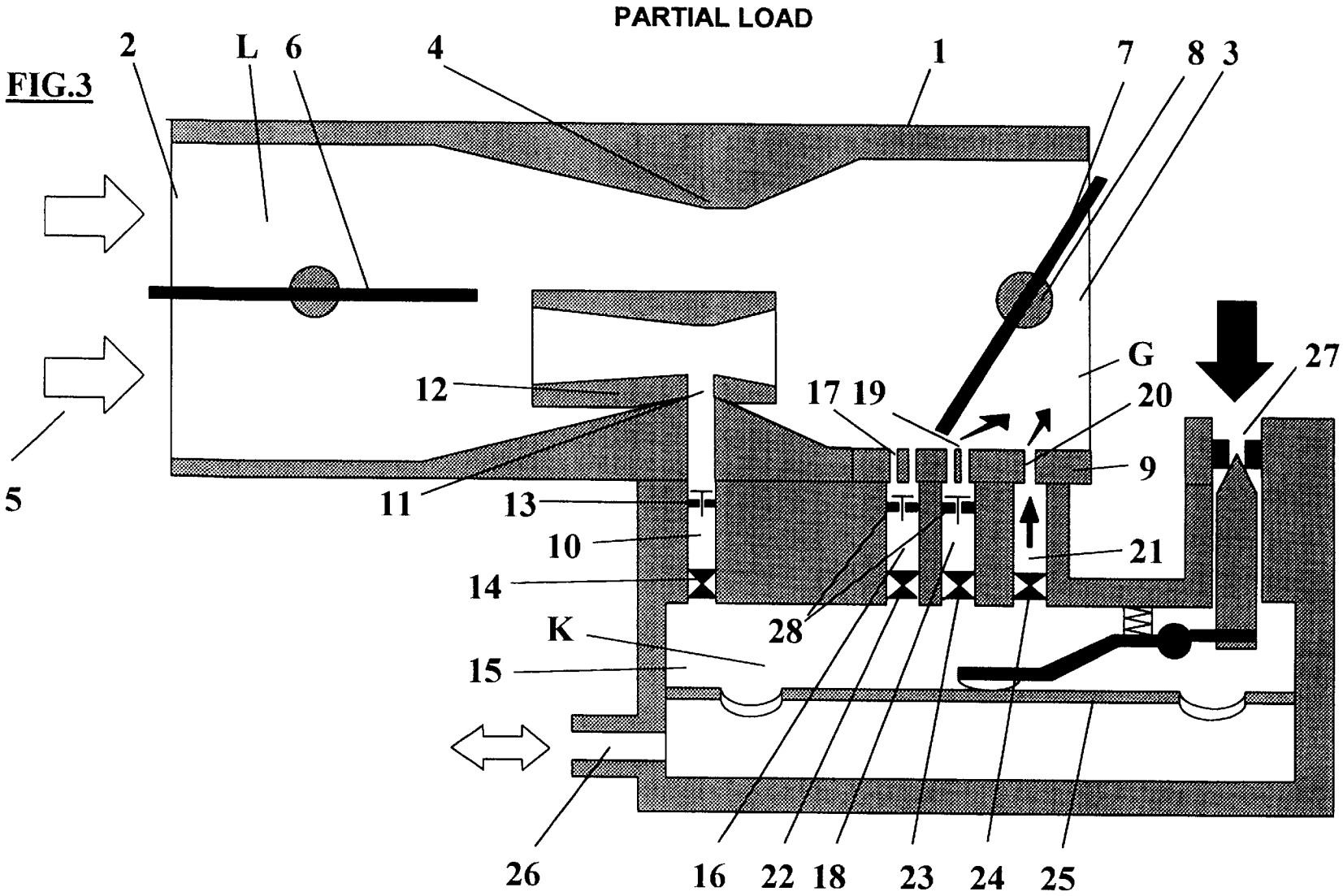
FIG. 3 is a vertical-sectional view of the diaphragm carburetor of FIG. 1 in a partial-load operation.

FIG. 3 shows the diaphragm carburetor with the fixed throttle, in the lower partial load mode, that is in partial-load operation through the lower partial load conduit. As compared with the position of FIG. 1, in this case the throttle valve 7 is tilted out of the nearly vertical position relative to the air flow direction 5 and is located in a partly open position. With an increasing opening of the throttle valve 7, the negative pressure range is propagated in the direction of the inlet-side opening 2 of the aspiration conduit 1 and thus reaches the two outlet openings 19 of the lower partial load conduit 18 in succession. The partial load fuel emerging from these conduits as a result of the draft covers the increased fuel demand of the motor as compared with the idling mode.

The upper partial-load mode is not shown in further detail. The outlet openings 17 of the upper partial load conduit or transition conduit 16 enter the negative pressure range as a consequence of a further opening of the throttle valve 7 in the upper partial-load mode. A significant expulsion of fuel does not occur through the main channel 10 until full-load operation, which is also not shown. The throttle valve 7 is then at least nearly fully open, so that a negative pressure prevails in the region of the outlet opening 11 as well.

We claim:

1. A diaphragm carburetor, comprising:

an aspiration conduit for air;

a diaphragm-controlled control chamber for fuel; and a number of fuel conduits communicating between said control chamber and said aspiration conduit, said fuel conduits including at least one partial load conduit with a given length and one idling conduit, at least one partial load conduit extended separately over all of said given length from said idling conduit, said at least one partial load conduit and said idling conduit communicating separately with said control chamber.

2. The diaphragm carburetor according to claim 1, wherein each of said fuel conduits is blocked for air ducting, independently of an operating state.

3. The diaphragm carburetor according to claim 2, including at least one check valve disposed in at least one partial load conduit.

4. The diaphragm carburetor according to claim 1, wherein said fuel conduits include two partial load conduits extended separately from one another over all of said given length.

5. The diaphragm carburetor according to claim 1, wherein at least one partial load conduit has at least one outlet opening for fuel leading to an interior of said aspiration conduit.

6. The diaphragm carburetor according to claim 1, wherein at least one partial load conduit has two outlet openings for fuel disposed successively in flow direction of aspirated air and leading to an interior of said aspiration conduit.

7. The diaphragm carburetor according to claim 1, including a throttle valve disposed in said aspiration conduit.

8. The diaphragm carburetor according to claim 1, wherein said aspiration conduit has a region shaped as a Venturi portion, and said main channel has an outlet opening discharging into said Venturi portion.

9. The diaphragm carburetor according to claim 8, including a preatomizer disposed in said Venturi portion, said main channel discharging into said preatomizer.

10. The diaphragm carburetor according to claim 8, including a throttle valve disposed in said aspiration conduit, said at least one partial load conduit having at least one outlet opening, said outlet openings of said at least one partial load conduit and said main channel to be activated in succession by positioning said throttle valve for discharging fuel unmixed with air through said outlet openings into said aspiration conduit.

11. The diaphragm carburetor according to claim 1, including nozzle elements, at least one nozzle element disposed in at least one partial load conduit and in said idling conduit, for independent regulation of flow rates of partial-load and idling fuel.

12. The diaphragm carburetor according to claim 11, wherein said nozzle element disposed in said idling conduit is a fixed throttle.

13. The diaphragm carburetor according to claim 11, wherein said nozzle element disposed in said idling conduit is an adjustable needle valve.

* * * * *